US011427787B2

(12) United States Patent
Rightmire et al.

(10) Patent No.: US 11,427,787 B2
(45) Date of Patent: Aug. 30, 2022

(54) SURFACTANT BLEND FOR REMOVAL OF FATTY SOILS

(71) Applicant: ECOLAB USA INC., Saint Paul, MN (US)

(72) Inventors: Kelly Anne Rightmire, Saint Paul, MN (US); Carter M. Silvernail, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 177 days.

(21) Appl. No.: 16/722,206

(22) Filed: Dec. 20, 2019

(65) Prior Publication Data

US 2020/0199490 A1 Jun. 25, 2020

Related U.S. Application Data

(60) Provisional application No. 62/782,979, filed on Dec. 20, 2018.

(51) Int. Cl.

| | |
|---|---|
| ***C11D 1/72*** | (2006.01) |
| ***C11D 3/10*** | (2006.01) |
| ***C11D 3/26*** | (2006.01) |
| ***C11D 3/30*** | (2006.01) |
| ***C11D 3/33*** | (2006.01) |
| ***C11D 11/00*** | (2006.01) |
| ***C11D 3/04*** | (2006.01) |

(Continued)

(52) U.S. Cl.

CPC ..... *C11D 1/72* (2013.01); *C11D 1/00* (2013.01); *C11D 3/044* (2013.01); *C11D 3/10* (2013.01); *C11D 3/30* (2013.01); *C11D 3/32* (2013.01); *C11D 3/33* (2013.01); *C11D 3/43* (2013.01); *C11D 7/00* (2013.01); *C11D 7/50* (2013.01); *C11D 11/0041* (2013.01)

(58) Field of Classification Search

CPC .. C11D 1/00; C11D 3/044; C11D 3/10; C11D 3/30; C11D 3/33; C11D 3/43; C11D 7/00; C11D 3/3209; C11D 3/32; C11D 7/50

USPC ..... 510/238, 245, 384, 477, 499, 509

See application file for complete search history.

(56) References Cited

U.S. PATENT DOCUMENTS

| | | | |
|---|---|---|---|
| 5,945,394 | A | 8/1999 | Sajic et al. |
| 6,218,346 | B1 | 4/2001 | Sajic et al. |

(Continued)

FOREIGN PATENT DOCUMENTS

| | | | |
|---|---|---|---|
| EP | 2970823 | A1 | 1/2016 |
| EP | 2984160 | B1 | 3/2017 |

(Continued)

OTHER PUBLICATIONS

Stepan Company, "BIO-SOFT® N-Series Blends", Informational Handout, 2 pages, Dec. 2018.

(Continued)

*Primary Examiner* — Gregory R Delcotto

(74) *Attorney, Agent, or Firm* — McKee, Voorhees & Sease, PLC

(57) ABSTRACT

Alkaline cleaning compositions with a blend of an amine and a nonionic alcohol ethoxylate between about 1:2 to about 1:10, preferably about 1:5 to about 1:10, with an alkalinity source and chelant are provided. The cleaning compositions provide efficacious cleaning of fatty soils to enhance fatty soil removal. Methods of cleaning surfaces using the cleaning composition are also disclosed.

14 Claims, 1 Drawing Sheet

(51) Int. Cl.

| | |
|---|---|
| ***C11D 3/43*** | (2006.01) |
| ***C11D 1/00*** | (2006.01) |
| ***C11D 7/00*** | (2006.01) |
| ***C11D 3/32*** | (2006.01) |
| ***C11D 7/50*** | (2006.01) |

(56) References Cited

U.S. PATENT DOCUMENTS

| | | | | |
|---|---|---|---|---|
| 6,583,181 | B1 | 6/2003 | Chiang et al. | |
| 2002/0169099 | A1 | 11/2002 | Knox et al. | |
| 2004/0258649 | A1* | 12/2004 | Peggau | C11D 1/65 424/70.21 |
| 2005/0054702 | A1 | 3/2005 | Dunn et al. | |
| 2006/0094638 | A1* | 5/2006 | Mohr | A01N 33/12 510/504 |
| 2010/0081596 | A1* | 4/2010 | Rong | C11D 3/3738 510/218 |
| 2015/0318017 | A1 | 11/2015 | Aono et al. | |
| 2017/0079265 | A1 | 3/2017 | Olson et al. | |
| 2017/0079266 | A1 | 3/2017 | Olson et al. | |
| 2017/0088795 | A1 | 3/2017 | Soontravanich et al. | |
| 2018/0066213 | A1 | 3/2018 | Lo et al. | |
| 2018/0072967 | A1 | 3/2018 | Sun et al. | |
| 2018/0087009 | A1 | 3/2018 | Man et al. | |
| 2018/0110224 | A1 | 4/2018 | Li et al. | |
| 2018/0127688 | A1 | 5/2018 | Nagel et al. | |
| 2018/0132481 | A1 | 5/2018 | Jiang et al. | |
| 2018/0208875 | A1 | 7/2018 | Man et al. | |
| 2019/0330565 | A1* | 10/2019 | Mutch | C11D 1/62 |
| 2020/0063070 | A1* | 2/2020 | Mutch | C08F 220/28 |

FOREIGN PATENT DOCUMENTS

| | | | |
|---|---|---|---|
| WO | 9919438 | A1 | 4/1999 |
| WO | 2012062372 | A1 | 5/2012 |
| WO | 2014058402 | A2 | 4/2014 |
| WO | 2017083798 | A1 | 5/2017 |
| WO | 2017222963 | A1 | 12/2017 |
| WO | 2018136693 | A1 | 7/2018 |

OTHER PUBLICATIONS

Mondin et al., "Characterization and qualification of N-(3-aminopropyl)-N-dodecyl-1, 3-propanediamine biocide by NMR, HPLC/MS and titration techniques", Chemosphere, vol. 95, pp. 379-386, Jan. 2014.

Raney, Kirk H., "Optimization of Nonionic/Anionic Surfactant Blends for Enhanced Oily Soil Removal", JAOCS, vol. 38, No. 7, 2 pages, Jul. 1991.

International Searching Authority in connection with PCT/US2019/067734 filed Dec. 20, 2019, "The International Search Report and the Written Opinion of the International Searching Authority, or the Declaration", 9 pages, dated May 13, 2020.

* cited by examiner

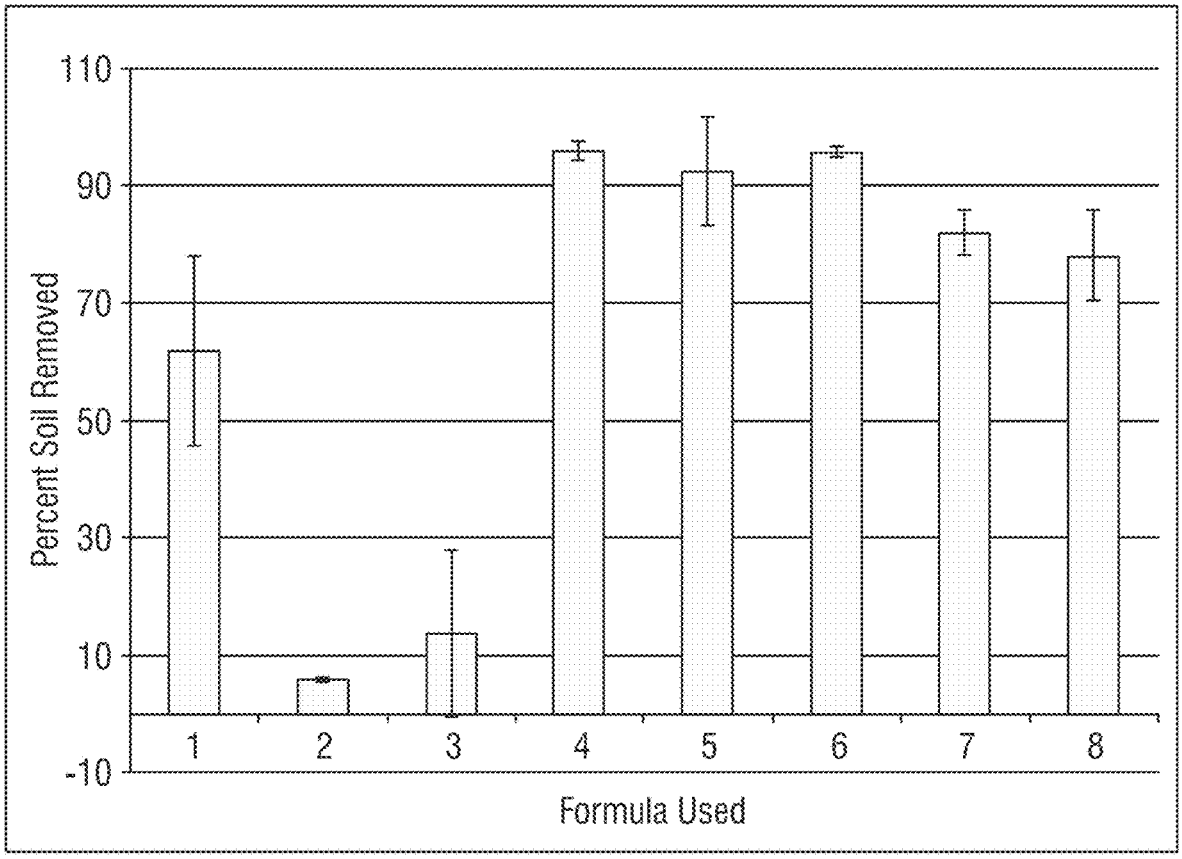
110
90
70
50
30
10
-10
Percent Soil Removed
1
2
3
4
5
6
7
8
Formula Used

SURFACTANT BLEND FOR REMOVAL OF FATTY SOILS

CROSS-REFERENCE TO RELATED APPLICATIONS

This application claims priority under 35 U.S.C. § 119 to provisional application U.S. Ser. No. 62/782,979, filed Dec. 20, 2018, herein incorporated by reference in its entirety. The entire contents of this patent application are hereby expressly incorporated herein by reference including, without limitation, the specification, claims, and abstract, as well as any figures, tables, or drawings thereof.

FIELD OF THE INVENTION

The invention relates to cleaning compositions with a blend of an amine and a nonionic alcohol ethoxylate between about 1:2 to about 1:10, preferably about 1:5 to about 1:10, to provide efficacious cleaning of fatty soils. The cleaning compositions provide superior fatty soil removal at alkaline pH conditions. Methods of cleaning surfaces using the cleaning composition are also provided.

BACKGROUND OF THE INVENTION

Multiple soils are present in institutional and other settings requiring the removal of, cleaning, sanitizing and/or disinfecting of protein, fat and oil, and starch-based soils. Often the fatty soils end up on hard surfaces and are difficult to remove, requiring aggressive cleaning products and/or elevated temperatures. Therefore, there is an ongoing need for effective cleaning products.

In many instances food and beverage plants that process meat components utilize foaming cleaners to clean the open surfaces in the plant including walls, ceilings, and processing equipment. Often a higher temperature is used because of the difficulty of removing the fatty soils associated with meat processing such as chicken fat, beef tallow, and lard. The use of a higher temperature leads to both increased energy costs associated with heating the water and fogging issues that are seen when the hot water is used in a cold plant. Formulations that are capable of removing fatty soils at lower temperatures are therefore desirable in order to combat these obstacles.

It is therefore an object of this disclosure to provide cleaning compositions that are able to efficiently remove soils, particularly fatty soils.

It is a further object of the disclosure to provide cleaning compositions for cleaning any open surface, including those in food and beverage plants, that may include various types of hard surfaces.

Other objects, aspects and advantages of this invention will be apparent to one skilled in the art in view of the following disclosure, the drawings, and the appended claims.

SUMMARY OF THE INVENTION

An advantage of the cleaning compositions is an improved removal of fatty soils on a variety of surfaces, including open surfaces in food and beverage plants which can include ceramic, stainless steel, and polymeric surfaces.

Cleaning compositions are provided comprising from about 0.1 wt-% to about 10 wt-% of an amine; from about 0.1 wt-% to about 20 wt-% of a nonionic alcohol ethoxylate surfactant, wherein the ratio of the amine to the nonionic alcohol ethoxylate surfactant is from about 1:2 to about 1:10, preferably from about 1:5 to about 1:10; a chelant; and an alkalinity source. The compositions can further include a chelant, such as an aminocarboxylic acid and/or a polycarboxylate polymer. The compositions can further include a solvent.

Methods of cleaning are provided that include contacting a surface with the cleaning compositions, and removing fatty soils from the surface. The methods can include cleaning hard surfaces. In some aspects, the surface is ceramic, stainless steel and/or polymeric. In some aspects, the surface is an open surface in a food and/or beverage plant. In some aspects, the cleaning composition is applied at a temperature range between about 20° C. to about 50° C.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

BRIEF DESCRIPTION OF THE DRAWINGS

FIG. 1 is a graph showing the results of a Red Stripe Test illustrating the percent soil removal of various formulations tested.

Various embodiments of the present invention will be described in detail with reference to the drawings, wherein like reference numerals represent like parts throughout the several views. Reference to various embodiments does not limit the scope of the invention. FIGURES represented herein are not limitations to the various embodiments according to the invention and are presented for exemplary illustration of the invention.

DETAILED DESCRIPTION OF THE PREFERRED EMBODIMENTS

The embodiments are not limited to particular cleaning compositions, which can vary and are understood by skilled artisans. It has been surprisingly found that cleaning compositions including a preferred ratio of an amine and nonionic alcohol ethoxylate surfactant provide unexpected fatty soil removal efficacy.

It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers within the defined range. Throughout this disclosure, various aspects are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments without undue experimentation, but the preferred materials and methods are described herein. In describing and claiming the embodiments, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

A surface can be made from, for example, stainless steel, plastics, polyethylene, polypropylene, aluminum, marble, granite, rubber, concrete, the like, or a combination thereof.

As used herein, the term "free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

The term "meat processing" means any process or operation to convert a living animal or any part thereof into a meat product ready for sale or use in the consumer marketplace, it includes but is not limited to one or more of such steps as pre-slaughtering preparation, slaughtering, eviscerating, defeathering, skinning, deboning, part sorting, organ removal, meat packing, fat rendering, cutting, chopping, mechanically separating, comminuting, mixing/tumbling, curing, spicing, adding non-meat additives, stuffing/filling into casings or other containers, fermenting, drying, chilling, freezing, cooking, irradiating, smoking, salting, blood draining, pickling, heating, dipping, spraying, and the like, and/or any step conducted prior to or subsequent to any one or more of these steps.

The term "surfactant" or "surface active agent" refers to an organic chemical that when added to a liquid changes the properties of that liquid at a surface.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions may comprise, consist essentially of, or consist of the components and ingredients as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Cleaning Compositions

According to embodiments, the cleaning compositions provide alkaline compositions with a blend of an amine and a nonionic alcohol ethoxylate surfactant. The cleaning compositions can also include additional functional ingredients and can be provided as concentrate or use compositions. Exemplary liquid cleaning compositions are shown in Table 1 on a weight percentage basis. Exemplary solid cleaning compositions are shown in Table 2 on a weight percentage basis.

TABLE 1

| Material | First Exemplary Range wt.-% | Second Exemplary Range wt.-% | Third Exemplary Range wt.-% |
|---|---|---|---|
| Alkalinity source | 1-70 | 1-50 | 1-30 |
| Amine | 0.1-10 | 0.5-5 | 0.5-3 |
| Nonionic alcohol ethoxylate surfactant | 0.1-20 | 1-10 | 2-5 |
| Water | 10-80 | 20-80 | 30-70 |
| Additional Functional Ingredients (e.g. chelants) | 0.1-90 | 0.1-75 | 0.1-50 |

TABLE 2

| Material | First Exemplary Range wt.-% | Second Exemplary Range wt.-% | Third Exemplary Range wt.-% |
|---|---|---|---|
| Alkalinity source | 30-90 | 45-90 | 55-90 |
| Amine | 0.1-40 | 0.5-20 | 1-10 |
| Nonionic alcohol ethoxylate surfactant | 0.1-40 | 0.5-20 | 0.5-10 |

TABLE 2-continued

| Material | First Exemplary Range wt.-% | Second Exemplary Range wt.-% | Third Exemplary Range wt.-% |
|---|---|---|---|
| Water | 0-50 | 0-35 | 0-25 |
| Additional Functional Ingredients (e.g. chelants) | 0.1-50 | 0.1-40 | 0.1-30 |

In an aspect the ratio of the amine to the nonionic alcohol ethoxylate surfactant is from about 1:2 to about 1:10, from about 1:5 to about 1:10, from about 1:5 to about 1:9, from about 1:5 to about 1:8, from about 1:5 to about 1:7, from about 1:6 to about 1:8, from about 1:7 to about 1:8, or about 1:8. In another aspect, the ratio of the amine to the nonionic alcohol ethoxylate surfactant is from about 1:2 to about 1:10, from about 1:5 to about 1:10, from about 1:6 to about 1:10, from about 1:6 to about 1:9, from about 1:7 to about 1:9, from about 1:7 to about 1:8, or about 1:8. In addition, without being limited according to the invention, all ranges recited are inclusive of the numbers defining the range and include each integer within the defined range.

In some embodiments, the cleaning compositions do not include additional surfactants. Specifically, the cleaning compositions do not include anionic surfactants, including extended chain anionic surfactants. Without being limited to a particular mechanism, the amine charge is not stable in a formulation with an anionic surfactant, including extended chain anionic surfactants.

Alkalinity Source

The cleaning compositions include an alkalinity source. In an aspect, the cleaning composition can include a neutral base. Examples of suitable alkaline sources include, but are not limited to carbonate-based alkalinity sources, including, for example, an alkali metal carbonate; caustic-based alkalinity sources, including, for example, alkali metal hydroxides; other suitable alkalinity sources may include metal silicate, metal borate, and organic alkalinity sources. Exemplary alkali metal carbonates that can be used include, but are not limited to, sodium carbonate, potassium carbonate, bicarbonate, sesquicarbonate, and mixtures thereof. Exemplary alkali metal hydroxides that can be used include, but are not limited to sodium, lithium, or potassium hydroxide. Exemplary metal silicates that can be used include, but are not limited to, sodium or potassium silicate or metasilicate. Exemplary metal borates include, but are not limited to, sodium or potassium borate.

Organic alkalinity sources are often strong nitrogen bases including, for example, ammonia (ammonium hydroxide), amines, alkanolamines, and amino alcohols. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

In some embodiments, the cleaning composition disclosed herein can include an alkali metal carbonate, alkali metal bicarbonate; alkanolamine, or combination thereof. In some embodiments, the cleaning composition provided as a liquid can include an alkali metal hydroxide and/or alkali metal carbonate.

In some embodiments, the alkalinity source is included in the cleaning composition at an amount of at least about 1 wt-% to about 70 wt-%, about 1 wt-% to about 60 wt-%, about 1 wt-% to about 50 wt-%, about 1 wt-% to about 40 wt-%, about 1 wt-% to about 30 wt-%, about 1 wt-% to about 20 wt-%, or about 1 wt-% to about 10 wt-%. In addition, without being limited according to the invention, all ranges recited are inclusive of the numbers defining the range and include each integer within the defined range.

Amine

The cleaning compositions include at least one amine. As referred to herein the amine may be referred to as a bis (3-aminopropyl) dodecylamine, 1, 3-propanediamine, N-(3-aminopropyl)-N-dodecylamine, Dodecylamine, or N,N-bis (3-aminopropyl) laurylamine, or may be represented by one of the formulas (1)

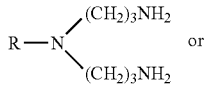

(2)

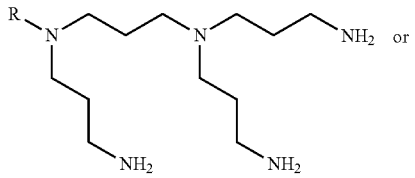

(3)

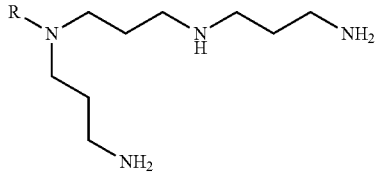

wherein R is a linear or branched alkyl residue with C1-22, C1-C18, or C1-12. The residue R of the amines can be saturated, unsaturated, mono- or polyunsaturated. In a preferred aspect R is a straight chain alkyl group, preferably C1-C12, or more preferably $C_{12}H_{25}$. Such amines can be produced according to processes known in the literature and/or are available as commercial products. A commercially available amine is available under the tradename Lonzabac® sold by Lonza Inc. as shown in Formula I wherein R is a linear C12 chain. Further commercially available amines include N-coco-1,3-propylene diamine, N-oleyl-1,3-propylene diamine, N-tallow-1,3-propylene diamine, mixtures thereof, or salts thereof, such N-alkyl-1, 3-propylene diamines are available from Akzo Chemie America and Armak Chemicals.

As referred to herein the amine may further be described as an alkylamine. The amine may further be described as an alkylamine of mono-, di- and/or polyamines.

Exemplary amines may include, for example, those selected from the following formulas:

$$R—NH—(CH_2)_rNH_2 \quad (1a)$$

$$R—NH—(CH_2)_rN^+H_3X^- \quad (1b)$$

$$R—N^+H_2—(CH_2)_rNH_32X^- \quad (1c)$$

$$R—NH—[(CH_2)_rNH]_y—(CH_2)_m—NH_2 \quad (2a)$$

$$R—NH—[(CH_2)_r—NH]_y(CH_2)_m—NH_2(H^+X^-)_n \quad (2b)$$

$$R_2—NY \quad (3a)$$

$$R_2—NY_2^+X'' \quad (3b)$$

wherein, R is a linear or branched alkyl residue, preferably with 6 to 22 C atoms, wherein Y independently represents hydrogen or a methyl group, wherein X" is an equivalent of an anion, selected from the group comprising an amidosulfonate, nitrate, halide, sulfate, hydrogen carbonate, carbonate, phosphate, hydroxide, carboxylate, and/or organic acid, wherein m, r, and y independently represent an integer ranging from 1 to 6, and wherein n is an integer ranging from 1 to 2+y.

In an aspect, the residue R of the amines can be a linear or branched alkyl residue with 6 C atoms to 22 C atoms, preferably 8 C atoms to 20 C atoms, further preferred 10 C atoms to 18 C atoms and also preferred 12 C atoms to 16 C atoms or 14 C atoms. In a further aspect, the residue R of the amines can be saturated, unsaturated, mono- or polyunsaturated. In a still further aspect, preferred amines include amines, wherein R is C8 to C18 alkyl, most preferred C8 to C12 alkyl. In an aspect, m, r, and y independently represent an integer ranging from 2 to 5 or 3 to 4 and most preferred 3.

In an aspect, dialkylamines, trialkylamines, alkyldiamines and/or alkyltriamines can be preferred, including cocopropylenediamine, oleyldipropylenetriamine, tallowdipropylenetriamine, oleylpropylenediamine, tallow-dipropylenetriamine, oleyltripropylenetetramine, N-3-aminopropyl-N-dodecyl-1,3-propane-diamine and/or a salt with X" thereof. The anion X" can be an amidosulfonate, nitrate, halide, sulfate, hydrogen carbonate, carbonate, phosphate, hydroxide, carboxylate, and/or organic acid.

The amine may further be described as an alkanolamine. Exemplary amines may include, for example, those selected from the following formulas:

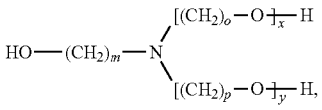

(4)

where m and, if present, o and p independently of one another have the value 2 or 3, and x and y independently of one another have the value 0 or 1, or a corresponding salt; in the mass ratio (I):(II) of 20:1 to 1:20. Alkyl, here and hereinafter, is taken to mean in each case unbranched or branched alkyl groups of the specified number of carbons, and particularly preferably those having an even number of carbon atoms.

Exemplary alkanolamines are in principle all ethanolamines and propanolamines, in particular mono-ethanolamine, diethanolamine, triethanolamine and 3-amino-1-propanol. In an aspect, a preferred alkanolamine compounds has a primary amino group, that is to say using monoethanolamine and 3-amino-1-propanol.

In an aspect, the amines for use according to the invention may include any mixture of different amines, or alkylamines, or alkanolamines.

As referred to herein, the amines may correspond to any of the general formulas, and can be produced according to processes known in the literature and/or are available as commercial products.

In some embodiments, the amine is included in the cleaning composition at an amount of at least about 0.01 wt-% to about 10 wt-%, about 0.1 wt-% to about 10 wt-%, about 0.5 wt-% to about 10 wt-%, about 0.5 wt-% to about 5 wt-%, about 0.5 wt-% to about 3 wt-%, or about 0.5 wt-% to about 2 wt-%. In addition, without being limited according to the invention, all ranges recited are inclusive of the numbers defining the range and include each integer within the defined range.

Alcohol Ethoxylate Surfactant

The cleaning compositions include at least one alcohol ethoxylate surfactant. The surfactant is a nonionic alcohol ethoxylate surfactant, including branched or linear surfactants. Preferably, the alcohol ethoxylate surfactant is linear and includes an alkyl group that has 20 or fewer carbon atoms. In at least some embodiments, the alcohol ethoxylate surfactants have the structure represented by Formula I:

$$R—O—(CH_2CH_2O)_n—H$$

wherein R is a linear or branched ($C_1$-$C_{20}$) alkyl group and n is an integer in the range of 1 to 100. In some embodiments, R may be a linear or branched ($C_1$-$C_{18}$) alkyl group, R may be a linear or branched ($C_5$-$C_{15}$) alkyl group, R may be a linear or branched ($C_{10}$-$C_{15}$) alkyl group or R may be a linear or branched ($C_{12}$-$C_{13}$) alkyl group. As referred to herein the R can also be a blend of the $C_1$-$C_{20}$ alkyl groups. In some embodiments, n is an integer in the range of 1 to 50, or in the range of 1 to 35, or in the range of 1 to 25, or in the range of 1 to 10. In some embodiments, the alcohol ethoxylate surfactants are linear chain hydrophobes. In some embodiments more than one alcohol ethoxylate surfactant is included in the cleaning composition and/or the surfactant is a blend of alkyl chain lengths.

In some embodiments, the alcohol ethoxylate surfactant is included in the cleaning composition at an amount of at least about 0.01 wt-% to about 20 wt-%, about 0.1 wt-% to about 10 wt-%, about 0.5 wt-% to about 10 wt-%, about 1 wt-% to about 10 wt-%, about 1 wt-% to about 5 wt-%, or about 2 wt-% to about 5 wt-%. In addition, without being limited according to the invention, all ranges recited are inclusive of the numbers defining the range and include each integer within the defined range.

Additional Functional Ingredients

The components of the cleaning composition can further be combined with various functional components suitable for uses disclosed herein, including hard surface cleaning compositions. In some embodiments, the cleaning compositions including the alkalinity source, amine and nonionic alcohol ethoxylate surfactant make up a large amount, or even substantially all of the total weight of the compositions. For example, in some embodiments few or no additional functional ingredients are disposed therein.

In other embodiments, additional functional ingredients may be included in the cleaning compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning. However, other embodiments may include functional ingredients for use in other applications.

In some embodiments, the cleaning compositions may include builders/sequestrants/chelating agents, polymers for hard water control, optical brighteners, defoaming agents, anti-redeposition agents, bleaching agents, solubility modifiers, dispersants, metal protecting agents, soil antiredeposition agents, stabilizing agents, corrosion inhibitors, such as benzotriazoles, enzymes, aesthetic enhancing agents including fragrances and/or dyes, additional rheology and/or solubility modifiers or thickeners, hydrotropes or couplers, buffers, solvents, preservatives, additional cleaning agents and the like.

These additional ingredients can be pre-formulated with the cleaning compositions or added to the use solution before, after, or substantially simultaneously with the addition of the compositions. Additionally, the compositions can be used in conjunction with one or more conventional cleaning and/or bleaching agents.

According to embodiments of the invention, the various additional functional ingredients—alone or in combination—may be provided in a composition in the amount from about 0.1 wt-% and about 90 wt-%, from about 0.1 wt-% and about 75 wt-%, from about 0.1 wt-% and about 50 wt-%, from about 0.01 wt-% and about 50 wt-%, from about 0.1 wt-% and about 50 wt-%, from about 1 wt-% and about 50 wt-%, from about 1 wt-% and about 30 wt-%, from about 1 wt-% and about 25 wt-%, or from about 1 wt-% and about 20 wt-%. In addition, without being limited according to the invention, all ranges recited are inclusive of the numbers defining the range and include each integer within the defined range.

Chelants

In some embodiments, the cleaning compositions include a chelant. Chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant.

Suitable aminocarboxylic acid type chelants include the acids, or alkali metal salts thereof. Some examples of aminocarboxylic acid materials include amino acetates and salts thereof. Some examples include the following: N-hydroxyethylaminodiacetic acid; hydroxyethylenediaminetetraacetic acid, nitrilotriacetic acid (NTA); ethylenediaminetetraacetic acid (EDTA); N-hydroxyethyl-ethylenediaminetriacetic acid (HEDTA); diethylenetriaminepentaacetic acid (DTPA); and alanine-N,N-diacetic acid; and the like; and mixtures thereof. Particularly useful aminocarboxylic acid materials containing little or no NTA and no phosphorus include: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), aspartic acid-N,N-diacetic acid (ASDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2,2'-iminodisuccinic acid (HIDS) and other similar acids having an amino group with a carboxylic acid substituent.

Other chelants include ethylenediaminetetra-acetates, N-hydroxyethylethylenediaminetriacetates, nitrilo-triacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Other suitable chelating agents can be selected from the group consisting of amino carboxylates, amino phosphonates, polyfunctionally-substituted aromatic chelating agents and mixtures thereof. Exemplary chelants include amino acids based chelants and preferably citrate, tartrate, and glutamic-N,N-diacetic acid and derivatives and/or phosphonate based chelants.

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts, such as sodium sulfate.

Other suitable chelating/sequestering agent(s) include polycarboxylate polymers, including water soluble polycarboxylate polymers. Such homopolymeric and copolymeric chelating/sequestering agent(s) include polymeric compositions with pendant (—$CO_2H$) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, polymaleic acid, polyfumaric acid, copolymers of acrylic and itaconic acid, phosphino polycarboxylate, acid or salt forms thereof, or mixtures thereof. Water soluble salts or partial salts of these polymers or copolymers such as their respective alkali metal (for example, sodium or potassium) or ammonium salts can also be used. The weight average molecular weight of the polymers is from about 4000 to about 90,000. An example of commercially available polycarboxylic acids (polycarboxylates) is ACUSOL 445 which is a homopolymer of acrylic acid with an average molecular weight of 4500 (Dow Chemicals). ACUSOL 445 is available as partially neutralized, liquid detergent polymer. Sokalan CP 5 is an acrylic acid/maleic acid copolymer available from BASF with a mean molar mass of 70000 g/mol.

Aminophosphonates are also suitable for use as chelating/sequestering agent(s) and include ethylenediaminetetramethylene phosphonates, nitrilotrismethylene phosphonates, and diethylenetriamine-(pentamethylene phosphonate) for example. These aminophosphonates commonly contain alkyl or alkenyl groups with less than 8 carbon atoms. These can also include phosphonic acid or phosphonate salt. Suitable phosphonic acids and phosphonate salts include 1-hydroxy ethylidene-1,1-diphosphonic acid (HEDP); ethylenediamine tetrakis methylenephosphonic acid (EDTMP); diethylenetriamine pentakis methylenephosphonic acid (DETPMP); cyclohexane-1,2-tetramethylene phosphonic acid; amino[tri(methylene phosphonic acid)]; (ethylene diamine[tetra methylene-phosphonic acid)]; 2-phosphono butane-1,2,4-tricarboxylic acid; or salts thereof, such as the alkali metal salts, ammonium salts, or alkylol amine salts, such as mono, di, or tetra-ethanolamine salts; picolinic, dipicolinic acid or mixtures thereof.

A preferred chelant includes gluconic acid. A preferred chelant includes methyl glycine diacetic acid.

In a preferred aspect, the chelant(s) is included in the cleaning composition at an amount of about 0.1 wt-% to about 20 wt-%, 0.1 wt-% to about 10 wt-%, or about 1 wt-% to about 8 wt-%. Without being limited according to the invention, all ranges recited are inclusive of the numbers defining the range and include each integer within the defined range.

Hydrotropes

In some embodiments, the cleaning compositions include a hydrotrope. Selected hydrotropes aid in the solubilization of one or more components of the cleaning composition. Exemplary hydrotropes include, for example, sodium xylene sulfonate (SXS) and sodium cumene sulfonates (SCS). Additional hydrotropes include for example, n-octanesulfonate, a xylene sulfonate, a naphthalene sulfonate, ethylhexyl sulfate, lauryl sulfate, etc.

In a preferred aspect, the hydrotrope is included in the cleaning composition at an amount of about 0 wt-% to about 25 wt-%, 0.1 wt-% to about 20 wt-%, or about 1 wt-% to about 20 wt-%. Without being limited according to the invention, all ranges recited are inclusive of the numbers defining the range and include each integer within the defined range.

Solvents

In some embodiments, the cleaning compositions includes at least one solvent. Exemplary solvents and solvent systems may include one or more different solvents including aromatic alcohols, alkanol amines, ether amines, amidines, esters, glycol ethers, and mixtures thereof. Representative solvents may include 1,8-Diazabicyclo[5.4.0]undec-7-ene, or also may be referred to as 2,3,4,6,7,8,9,10-Octahydropyrimidol[1,2-a]azepine (or DBU), 2.5.7.10-tetraoxaundecante (TOU), acetamidophenol, acetanilide, acetophenone, 2-acetyl-1-methylpyrrole, glycerine, benzyl acetate, benzyl alcohol, methyl benzyl alcohol, alpha phenyl ethanol, benzyl benzoate, benzyloxyethanol, ethylene glycol phenyl ether, propylene glycol phenyl ether, amyl acetate, amyl alcohol, butanol, 3-butoxyethyl-2-propanol, butyl acetate, n-butyl propionate, cyclohexanone, diacetone alcohol, diethoxyethanol, diethylene glycol methyl ether, diisobutyl carbinol, diisobutyl ketone, dimethyl heptanol, dipropylene glycol tert-butyl ether, ethanol, ethyl acetate, 2-ethylhexanol, ethyl propionate, ethylene glycol methyl ether acetate, hexanol, isobutanol, isobutyl acetate, isobutyl heptyl ketone, isophorone, isopropanol, isopropyl acetate, methanol, methyl amyl alcohol, methyl n-amyl ketone, 2-methyl-1-butanol, methyl ethyl ketone, methyl isobutyl ketone, 1-pentanol, n-pentyl propionate, 1-propanol, n-propyl acetate, n-propyl propionate, propylene glycol ethyl ether, tripropylene glycol methyl ether, tripropylene glycol n-butyl ether, diethylene glycol n-butyl ether acetate, diethylene glycol monobutyl ether, ethylene glycol n-butyl ether acetate, ethylene glycol monobutyl ether, dipropylene glycol monobutyl ether, propylene glycol monobutyl ether, ethyl 3-ethoxypropionate, 2,2,4-Trimethyl-1,3-Pentanediol Monoisobutyrate, diethylene glycol monohexyl ether, ethylene glycol monohexyl ether, diethylene glycol monomethyl ether, diethylene glycol monoethyl ether, ethylene glycol methyl ether acetate, ethylene glycol monomethyl ether, dipropylene glycol monomethyl ether, propylene glycol methyl ether acetate, propylene glycol monomethyl ether, diethylene glycol monopropyl ether, ethylene glycol monopropyl ether, dipropylene glycol monopropyl ether and propylene glycol monopropyl ether. Representative dialkyl carbonates include dimethyl carbonate, diethyl carbonate, dipropyl carbonate, diisopropyl carbonate and dibutyl carbonate. Representative oils include benzaldehyde, pinenes (alphas, betas, etc.), terpineols, terpinenes, carvone, cinnamealdehyde, borneol and its esters, citrals, ionenes, jasmine oil, limonene, dipentene, linalool and its esters. Representative dibasic esters include dimethyl adipate, dimethyl succinate, dimethyl glutarate, dimethyl malonate, diethyl adipate, diethyl succinate, diethyl glutarate, dibutyl succinate, dibutyl glutarate and products available under the trade designations DBE, DBE-3, DBE-4, DBE-5, DBE-6, DBE-9, DBE-IB, and DBE-ME from DuPont Nylon. Representative phthalate esters include dibutyl phthalate, diethylhexyl phthalate and diethyl phthalate. An additional solvent may include Butylal (Formaldehyde Dibutyl Acetal).

Preferred solvents for wetting of polymerized soils include benzyl alcohol, dibasic esters, essential oils, dialkyl carbonates, ethylene glycol monobutyl ether, diethylene glycol monobutyl ether, ethylene glycol phenyl ether, propylene glycol phenyl ether and mixtures thereof.

In a preferred aspect, the solvent(s) is included in the cleaning composition at an amount of about 0 wt-% to about 25 wt-%, 0.1 wt-% to about 20 wt-%, about 1 wt-% to about 20 wt-%, or about 1 wt-% to about 10 wt-%. Without being limited according to the invention, all ranges recited are inclusive of the numbers defining the range and include each integer within the defined range.

Methods of Use

The cleaning compositions are suited for cleaning various surfaces and objects. The cleaning compositions are efficacious in cleaning and removing soils, particularly fatty soils, from such surfaces and objects, such as from surfaces in food and beverage applications. The cleaning compositions can be used for a variety of domestic or industrial applications, e.g., to remove soils from a surface or object. The cleaning compositions can be applied in a variety of areas including kitchens, factories, and food plants, and can be applied to a variety of hard or soft surfaces having smooth, irregular or porous topography. Suitable hard surfaces include, for example, architectural surfaces (e.g., floors, walls, windows, sinks, tables, counters and signs); eating utensils; hard-surface medical or surgical instruments and devices; and hard-surface packaging. Such hard surfaces can be made from a variety of materials including, for example, ceramic, metal, glass, wood or polymeric surface. In a preferred aspect, the cleaning compositions are applied to a ceramic, stainless steel and/or hard plastic.

Preferred industries in which the methods of using the cleaning compositions can be applied include those having a significant amount of fatty soils, but are not limited to: the food and beverage industry, e.g., meat processing. Exemplary surfaces and objects in these industries include manufacturing or processing surfaces handling food products, including for example animal products. For example, the cleaning compositions can be used on food transport lines (e.g., as belt sprays); boot and hand-wash dip-pans; food storage facilities; anti-spoilage air circulation systems; refrigeration and cooler equipment; beverage chillers and warmers, blanchers, cutting boards, third sink areas, and meat chillers or scalding devices, and the like. Additional surfaces and equipment that may be contaminated with fatty soils may include evaporators, heat exchangers (including tube-in-tube exchangers, direct steam injection, and plate-in-frame exchangers), heating coils (including steam, flame or heat transfer fluid heated) re-crystallizers, pan crystallizers, spray dryers, drum dryers, membranes and tanks.

In some aspects, the methods of using the cleaning compositions include applying or contacting the compositions to surface, e.g., industrial equipment surface, to clean using clean in place cleaning procedures.

Conventional CIP processes are generally well known. The process includes applying or circulating a water diluted solution of cleaning concentrate (typically about 0.5-3% by volume) onto the surface to be cleaned. The solution flows across the surface (3 to 6 feet/second) to remove the soil. Either new solution is re-applied to the surface, or the same solution is re-circulated and re-applied to the surface as required to achieve a clean soil-free surface.

A typical CIP process to remove a soil (including organic, inorganic or a mixture of the two components) often includes at least three steps: an initial water rinse or previously used chemical rinse, an alkaline and/or acid solution wash, and a final fresh water rinse. Additional steps may include a separate acid or alkaline wash as well as a separate sanitizing step. The alkaline solution softens the soils and removes the organic alkaline soluble soils. The acid solution removes any remaining mineral soils. The strength of the alkaline and acid solutions, the duration of the cleaning steps and the cleaning solution temperature are typically dependent on the amount and tenacity of the soil. The water rinse removes any residual chemical solution and soils prior to the equipment being returned on-line for production purposes.

According to the methods, the use of CIP methods for the cleaning compositions refers to use of submerging an object into the cleaning composition, spraying on the cleaning composition, wiping with the cleaning composition, flow through applications, or the like.

The cleaning compositions can be applied to surfaces using a variety of methods. These methods can operate on an object, surface, or the like, by contacting the object or surface with the composition. Contacting can comprise any of numerous methods for applying a liquid, such as spraying the compound, immersing the object in the compound, foam or gel treating the object with the compound, or a combination thereof. Without being limited to the contacting according to the invention, a concentrate or use liquid composition can be applied to or brought into contact with an object by any conventional method or apparatus for applying a liquid composition to an object. For example, the surface can be wiped with, sprayed with, foamed on, and/or immersed in the liquid compositions, or use liquid compositions made from the concentrated liquid compositions. The liquid compositions can be sprayed, foamed, or wiped onto a surface; the compound can be caused to flow over the surface, or the surface can be dipped into the compound. Contacting can be manual or by machine.

The cleaning compositions are in contact with a surface or object for a sufficient amount of time to clean the surface or object. In an aspect, the surface or object is contacted with the cleaning composition for at least about 1 minute, at least about 10 minutes, between about 10 minutes and about 20 minutes, or between about 15 minutes and about 20 minutes.

The cleaning compositions can be applied at a use or concentrate solution to a surface or object in need of cleaning. In an aspect, a use concentration of the cleaning composition includes from about 1 wt % to about 10 wt %, or from about 1 wt % to about 5 wt %, or from about 3 wt % to about 5 wt %, including all ranges therebetween. Preferably a composition will be diluted with water to between a 3-5 wt-% cleaning concentration. However, in some embodiments, a concentrate composition may be employed and the dilution with water is not required.

The cleaning compositions can be applied at a use or concentrate solution pH between about 9 to about 14, or between about 11 and about 13.

The cleaning compositions beneficially provide at least about 85% soil removal of fatty soils from a treated surface. In further embodiments, the cleaning compositions beneficially provide at least about 90% soil removal of fatty soils from a treated surface.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The following ingredients are utilized in the Examples:

Acusol™ 445N (50% aqueous solution): Neutralized polyacrylic acid, available from the DOW Chemical Company;

BIO-SOFT® N-600: A nonionic surfactant blend of alcohol ethoxylates, where R is a linear C12-13 chain, and n=6, available from Stepan;

Biosoft N-400: A nonionic surfactant blend of alcohol ethoxylates, where 80-90% mixture, R is a linear C9-C11 chain, and 10-20% mixture, R is a C12-13 chain, wherein n (moles of EO) is 4, available from Stepan;

Ecosurf EH-6: A branched alcohol ethoxylate, where base is two ethyl hexanol, followed by PO, then EO (EO/PO proprietary), available from DOW Chemical;

Lonzabac® 12.100: An amine surfactant, available from Lonza;

Amine 736: A C18 linear triamine (structure 2a), available from Nalco;

Amine 737: A C14 branched triamine (structure 1), available from Nalco;

Amine 746: A C16 branched triamine (structure 1), available from Nalco;

Amine blend 816: A mixture of C21-C30 branched di-, tri-, tetra-, and pentamines (structure 2/3 blend), available from Nalco; and Trilon® M (40% aqueous solution): Methyl glycine diacetic acid, available from BASF Corporation.

Commercially available sodium cumene sulfonate 40%, diethylene glycol monobutyl ether, gluconic acid 50%, benzotriazole 99%, potassium hydroxide 45%, and dense ash.

Example 1

A Red Stripe Test was conducted to assess cleaning performance of formulations for various food and beverage applications. A soil mixture was prepared from beef tallow, pig lard, and iron (III) oxide (referred to as "soil mixture" throughout the Examples). About 2 grams of beef tallow was combined with about 2 grams of pig lard, and about 100 mg $Fe_2O_3$. The ratio of the soil mixture was about 1:1:0.05.

Tiles were prepared prior to testing by cleaning the surface of each tile with hot water, then with acetone, and leaving the tiles to dry. Two prepared tiles were placed side by side. Two strips of masking tape, 1.0 cm apart, were applied 1.0 cm from the top of each tile. A small amount of the soil mixture was then applied in between the tape strips to each tile using a foam brush. The two strips of masking tape were removed, and the soiled tiles were left to dry at room temperature for 10 minutes.

Meanwhile, 300 mL of a 3 wt-% aqueous solution of the test product was prepared using a 400 mL beaker and heating the test product to the desired test temperature, using a hot plate if needed. The test product was then loaded into Foam-Matic 1.25E, and the foam of the test product was then applied to the tiles. Photos of the tiles were captured using a digital camera at 0, 5, 10, and 20 minutes after spraying the tiles with the foam. Prior to the end of the 20 minutes, 600 mL of water was heated in a beaker to 30° C. After taking the photo of the tiles at 20 minutes, each tile was rinsed with 300 mL of the heated water. Another photo of the tiles was taken after rinsing with water.

The photos were then processed and analyzed using the ImageJ software. The photos were cropped to focus around the red stripe to be analyzed. The photos were analyzed using the ImageJ software by changing the settings to measure: Area, SD, Min gray value, Max gray value, Mean gray value, and Area fraction. The photos were then analyzed, and the measurements taken by the software were measured and recorded. Image analysis using the ImageJ software was repeated for each tile tested. The area fraction measured by the software is equivalent to the percent soil remaining on the tile. The test product formulations were prepared according to Table 3. They were evaluated at a use cleaning solution of 3% (having a total surfactant concentration (excluding Formulation 1) of 4.7%).

TABLE 3

| Ingredients | Formulation (wt-%) 1 | 2 | 3 | 4 | 5 | 6 | 7 | 8 |
|---|---|---|---|---|---|---|---|---|
| DI Water | 10-90 | 10-90 | 10-90 | 10-90 | 10-90 | 10-90 | 10-90 | 10-90 |
| Sodium Cumene Sulfonate, 40% | 1-15 | 1-15 | 1-15 | 1-15 | 1-15 | 1-15 | 1-15 | 1-15 |
| Diethylene glycol monobutyl ether | 1-10 | 1-10 | 1-10 | 1-10 | 1-10 | 1-10 | 1-10 | 1-10 |
| Trilon M, 40% | 1-5 | 1-5 | 1-5 | 1-5 | 1-5 | 1-5 | 1-5 | 1-5 |
| Gluconic acid, 50% | 1-3 | 1-3 | 1-3 | 1-3 | 1-3 | 1-3 | 1-3 | 1-3 |
| Acusol 445N | 1-4 | 1-4 | 1-4 | 1-4 | 1-4 | 1-4 | 1-4 | 1-4 |
| Lonzabac 12.100 | 0 | 4.68 | 2.34 | 1.56 | 0.78 | 0.52 | 0.43 | 0 |
| Biosoft N-600 | 0 | 0 | 2.34 | 3.12 | 3.90 | 4.16 | 4.25 | 4.68 |
| Benzotriazole, 99% | 0-1 | 0-1 | 0-1 | 0-1 | 0-1 | 0-1 | 0-1 | 0-1 |
| Potassium Hydroxide, 45% | 1-20 | 1-20 | 1-20 | 1-20 | 1-20 | 1-20 | 1-20 | 1-20 |
| Total | 100 | 100 | 100 | 100 | 100 | 100 | 100 | 100 |

Table 4 shows the surfactant ratio of the evaluated formulations, as well as the results of the average percent of soil removed. The surfactant ratio in Table 4 shows the amine to nonionic alcohol ethoxylate ratio. Additionally, FIG. 1 illustrates a graph comparing the percent soil removed of the evaluated formulations. The results of the graph show that the formulations with both surfactants, with the exception of formulation 3 having a ratio of amine to surfactant<1:2, exhibited superior soil removal over the formulations with only one surfactant, or no surfactant.

TABLE 4

| Formulation | Amine to Surfactant Ratio | Use Concentration (wt-%) | Test (Spray) Solution Temperature (° C.) | Average % Soil Removed |
|---|---|---|---|---|
| 1 | No Surfactant | 3 | 40 | 61.9 |
| 2 | No Biosoft | 3 | 40 | 5.8 |
| 3 | 1:1 | 3 | 40 | 13.6 |
| 4 | 1:2 | 3 | 40 | 95.7 |
| 5 | 1:5 | 3 | 40 | 92.3 |
| 6 | 1:8 | 3 | 40 | 95.5 |
| 7 | 1:10 | 3 | 40 | 81.6 |
| 8 | No Lonzabac | 3 | 40 | 77.7 |

The average soil removal calculated for the ratio of amine to surfactant between about 1:2 to about 1:8 demonstrated greater than about 85% soil removal, in fact all formulations achieved greater than 90% soil removal.

Example 2

Additional Red Stripe Testing according to the methods of Example 1 was done to evaluate the effect of various factors on the performance of the test formulations. Factors such as ash/carbonate compared to caustic/hydroxide and surfactant ratio were evaluated. The formulations were prepared according to Table 5 and include the ratio of the amine to nonionic alcohol ethoxylate.

TABLE 5

| Ingredient | Formulas (wt-%) 1 | 2 | 3 |
|---|---|---|---|
| DI Water | 10-90 | 10-90 | 10-90 |
| Sodium Cumene Sulfonate, 40% | 1-15 | 1-15 | 1-15 |
| Diethylene Glycol Monobutyl Ether | 1-10 | 1-10 | 1-10 |
| Trilon M (liquid) | 1-5 | 1-5 | 1-5 |
| Gluconic Acid, 50% | 1-3 | 1-3 | 1-3 |
| Acusol 445N | 1-4 | 1-4 | 1-4 |
| Lonzabac 12.100 | 1.558 | 0.779 | 2.3375 |

TABLE 5-continued

| Ingredient | Formulas (wt-%) 1 | 2 | 3 |
|---|---|---|---|
| Biosoft N-600 | 3.117 | 3.896 | 2.3375 |
| Benzotriazole, 99% | 0-1 | 0-1 | 0-1 |
| Potassium Hydroxide, 45% | 1-20 | 1-20 | 0 |
| Dense Ash | 0 | 0 | 0-5 |
| Active Surfactant Concentration | 4.675 | 4.675 | 4.675 |
| Surfactant Ratio | 1:2 | 1:5 | 1:1 |

The results for formulations 1-3 are shown in Table 6 showing the surfactant ratio of the evaluated formulations, as well as the results of the average percent of soil removed. The results show the formulations with both surfactants, with a ratio of at least 1:2 provide efficacious soil removal over the formulations with only a 1:1 ratio.

TABLE 6

| Formulation | Surfactant Ratio | Use Concentration (wt-%) | Test (Spray) Solution Temperature (° C.) | Average % Soil Removed |
|---|---|---|---|---|
| 3 | 1:1 | 3 | 40 | 70.8 |
| 1 | 1:2 | 3 | 40 | 95.7 |
| 2 | 1:5 | 3 | 40 | 92.3 |

The results are significant as the cleaning compositions with the amine to the nonionic alcohol ethoxylate surfactant ratio of at least 1:2 provide greater than 90% soil removal.

Example 3

Additional Red Stripe Testing according to the methods of Example 1 was performed to evaluate the cleaning performance of formulations containing a broader spectrum of amines and alcohol ethoxylates. A range of amines containing different branching patterns and carbon chain lengths were evaluated. Alcohol ethoxylates evaluated have a range of ethylene/propylene oxide content, as well as various branching patterns and carbon chain lengths. The formulations were prepared according to Table 7 and all utilize an amine to alcohol ethoxylate ratio of 1:8.

TABLE 7

| Ingredient | Formulas (wt-%) 1 | 2 | 3 | 4 | 5 | 6 |
|---|---|---|---|---|---|---|
| DI Water | 10-90 | 10-90 | 10-90 | 10-90 | 10-90 | 10-90 |
| Sodium Cumene Sulfonate, 40% | 1-15 | 1-15 | 1-15 | 1-15 | 1-15 | 1-15 |
| Diethylene Glycol Monobutyl Ether | 1-10 | 1-10 | 1-10 | 1-10 | 1-10 | 1-10 |
| Trilon M (liquid) | 1-5 | 1-5 | 1-5 | 1-5 | 1-5 | 1-5 |
| Gluconic Acid, 50% | 1-3 | 1-3 | 1-3 | 1-3 | 1-3 | 1-3 |
| Acusol 445N | 1-4 | 1-4 | 1-4 | 1-4 | 1-4 | 1-4 |
| Amine 736 | 0.52 | 0 | 0 | 0 | 0 | 0 |
| Amine 737 | 0 | 0.52 | 0 | 0 | 0 | 0 |
| Amine 746 | 0 | 0 | 0.52 | 0 | 0 | 0 |
| Amine blend 816 | 0 | 0 | 0 | 0.52 | 0 | 0 |
| Lonzabac 12.100 | 0 | 0 | 0 | 0 | 0.52 | 0.52 |
| BiosoftN-600 | 4.17 | 4.17 | 4.17 | 4.17 | 0 | 0 |
| Biosoft N-400 | 0 | 0 | 0 | 0 | 4.17 | 0 |
| Ecosurf EH-6 | 0 | 0 | 0 | 0 | 0 | 4.17 |
| Benzotriazole, 99% | 0-1 | 0-1 | 0-1 | 0-1 | 0-1 | 0-1 |

TABLE 7-continued

| Ingredient | Formulas (wt-%) 1 | 2 | 3 | 4 | 5 | 6 |
|---|---|---|---|---|---|---|
| Potassium Hydroxide, 45% | 1-20 | 1-20 | 1-20 | 1-20 | 1-20 | 1-20 |
| Active Surfactant Concentration | 4.7 | 4.7 | 4.7 | 4.7 | 4.7 | 4.7 |
| Amine to Surfactant Ratio | 1:8 | 1:8 | 1:8 | 1:8 | 1:8 | 1:8 |

The results for the above formulations are shown in Table 8. The results demonstrate the wide range of amines and alcohol ethoxylates that show the observed synergy and superior cleaning performance of fatty soils.

TABLE 8

| Formulation | Surfactant Ratio | Use Concentration (wt-%) | Test (Spray) Solution Temperature (° C.) | Average % Soil Removed |
|---|---|---|---|---|
| 1 | 1:8 | 3 | 40 | 99.1 |
| 2 | 1:8 | 3 | 40 | 90.8 |
| 3 | 1:8 | 3 | 40 | 97.7 |
| 4 | 1:8 | 3 | 40 | 94.9 |
| 5 | 1:8 | 3 | 40 | 92.9 |
| 6 | 1:8 | 3 | 40 | 96.7 |

The results further confirm the efficacy of the cleaning compositions with the amine to the nonionic alcohol ethoxylate surfactant ratio of at least 1:2 provide greater than 90% soil removal.

Example 4

Additional Red Stripe Testing according to the methods of Example 1 was performed to evaluate the cleaning performance of formulations containing a broader spectrum of amines and alcohol ethoxylates. A range of amines containing different branching patterns and carbon chain lengths were evaluated. Alcohol ethoxylates evaluated have a range of ethylene/propylene oxide content, as well as various branching patterns and carbon chain lengths. The formulations were prepared according to Table 9 and all utilize an amine to alcohol ethoxylate ratio of 1:2.

TABLE 9

| Ingredient | Formulas (wt-%) 1 | 2 | 3 | 4 | 5 | 6 |
|---|---|---|---|---|---|---|
| DI Water | 10-90 | 10-90 | 10-90 | 10-90 | 10-90 | 10-90 |
| Sodium Cumene Sulfonate, 40% | 1-15 | 1-15 | 1-15 | 1-15 | 1-15 | 1-15 |
| Diethylene Glycol Monobutyl Ether | 1-10 | 1-10 | 1-10 | 1-10 | 1-10 | 1-10 |
| Trilon M (liquid) | 1-5 | 1-5 | 1-5 | 1-5 | 1-5 | 1-5 |
| Gluconic Acid, 50% | 1-3 | 1-3 | 1-3 | 1-3 | 1-3 | 1-3 |
| Acusol 445N | 1-4 | 1-4 | 1-4 | 1-4 | 1-4 | 1-4 |
| Amine 736 | 1.56 | 0 | 0 | 0 | 0 | 0 |
| Amine 737 | 0 | 1.56 | 0 | 0 | 0 | 0 |
| Amine 746 | 0 | 0 | 1.56 | 0 | 0 | 0 |
| Amine blend 816 | 0 | 0 | 0 | 1.56 | 0 | 0 |
| Lonzabac 12.100 | 0 | 0 | 0 | 0 | 1.56 | 1.56 |
| Biosoft N-600 | 3.13 | 3.13 | 3.13 | 3.13 | 0 | 0 |
| Biosoft N-400 | 0 | 0 | 0 | 0 | 3.13 | 0 |
| Ecosurf EH-6 | 0 | 0 | 0 | 0 | 0 | 3.13 |
| Benzotriazole, 99% | 0-1 | 0-1 | 0-1 | 0-1 | 0-1 | 0-1 |
| Potassium Hydroxide, 45% | 1-20 | 1-20 | 1-20 | 1-20 | 1-20 | 1-20 |

TABLE 9-continued

| Ingredient | Formulas (wt-%) | | | | | |
|---|---|---|---|---|---|---|
| | 1 | 2 | 3 | 4 | 5 | 6 |
| Active Surfactant Concentration | 4.7 | 4.7 | 4.7 | 4.7 | 4.7 | 4.7 |
| Surfactant Ratio | 1:2 | 1:2 | 1:2 | 1:2 | 1:2 | 1:2 |

The results for the above formulations are shown in Table 10. The results demonstrate the wide range of amines and alcohol ethoxylates that show the observed synergy and superior cleaning performance of fatty soils.

TABLE 10

| Formulation | Amine to Surfactant Ratio | Use Concentration (wt-%) | Test (Spray) Solution Temperature (° C.) | Average % Soil Removed |
|---|---|---|---|---|
| 1 | 1:2 | 3 | 40 | 98.3 |
| 2 | 1:2 | 3 | 40 | 86.7 |
| 3 | 1:2 | 3 | 40 | 89.1 |
| 4 | 1:2 | 3 | 40 | 97.9 |
| 5 | 1:2 | 3 | 40 | 89.3 |
| 6 | 1:2 | 3 | 40 | 77.6 |

The results further confirm the efficacy of the cleaning compositions with the amine to the nonionic alcohol ethoxylate surfactant ratio of at least 1:2 provide greater efficacy. Increasing the amount of (ratio of) nonionic surfactant above 1:2 provides increased efficacy for certain amine structures. All formulas provided at least 85% soil removal or greater.

It is to be understood that while the invention has been described in conjunction with the detailed description thereof, the foregoing description is intended to illustrate, and not limit the scope of the invention, which is defined by the scope of the appended claims. Other embodiments, advantages, and modifications are within the scope of the following claims. In addition, the contents of all patent publications discussed supra are incorporated in their entirety by this reference.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A cleaning composition comprising:

from about 0.1 wt-% to about 10 wt-% of an amine, wherein the amine is selected from any one of the following formulas:

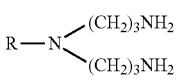

(1)

wherein R is a linear or branched C12-C16 alkyl group,

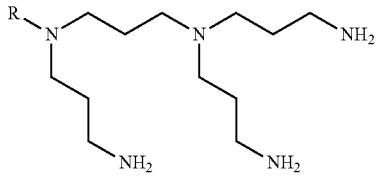

(2)

wherein R is a linear or branched C21-C30 alkyl group,

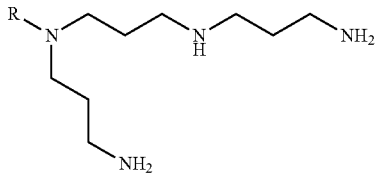

(3)

wherein R is a linear or branched C21-C30 alkyl group, $$R—NH—[(CH_2)_r NH]_y—(CH_2)_m—NH_2 \quad (2a)$$

wherein R is a linear or branched C18 alkyl group and wherein m, r, and y independently represent an integer ranging from 1 to 6; or combinations thereof;

from about 0.1 wt-% to about 20 wt-% of a nonionic alcohol ethoxylate surfactant, wherein the alcohol ethoxylate is according to the formula: $R—O—(CH_2CH_2O)_n—H$, wherein R is a linear C8-C13 alkyl group and n is an integer from 4 to 6, and wherein optionally the formula comprises a PO group, wherein the weight ratio of the amine to the nonionic alcohol ethoxylate surfactant is from 1:2 to 1:10;

a chelant; and an alkalinity source.

2. The composition of claim 1, wherein the weight ratio of the amine to the nonionic alcohol ethoxylate surfactant is from about 1:5 to about 1:10.

3. The composition of claim 1, wherein the alkalinity source is one of an alkali metal hydroxide, carbonate, borate and/or silicate.

4. The composition of claim 1, wherein the chelant is an aminocarboxylic acid.

5. The composition of claim 1, wherein the chelant is a polycarboxylate polymer.

6. The composition of claim 1, wherein the chelant comprises an aminocarboxylic acid and a polycarboxylate polymer.

7. The composition of claim 1, further comprising at least one solvent.

8. The composition of claim 1, further comprising at least one functional ingredient selected from additional surfactants, chelating agents, sequestering agents, detergents, additional alkaline sources, builders, bleaching agents, sanitizers, activators, builders, fillers, defoaming agents, anti-redeposition agents, optical brighteners, dyes, odorants, stabilizing agents, dispersants, enzymes, corrosion inhibitors, thickeners, solubility modifiers, or combinations thereof.

9. A method of cleaning comprising:

contacting a surface with the cleaning composition of claim 1; and removing fatty soils from the surface.

10. The method of claim 9, wherein the surface is a hard surface.

11. The method of claim 9, wherein the surface is ceramic, stainless steel and/or polymeric.

12. The method of claim 9, wherein the surface is an open surface in a food and/or beverage plant.

13. The method of claim 9, wherein the removal of fatty soils from the surface provides at least about 85% soil removal.

14. The method of claim 9, wherein the removal of fatty soils from the surface provides at least about 90% soil removal.

* * * * *